US009934914B2

(12) United States Patent
Chen et al.

(10) Patent No.: US 9,934,914 B2
(45) Date of Patent: Apr. 3, 2018

(54) HEART-SHAPED SELF-LOCKING BUTTON

(71) Applicants: Zhong Hui Chen, Suzhou (CN); Wei Ge, Tiantai (CN); Ling Li, Suzhou (CN); Song Liu, Suzhou (CN); Lei Tao, Shanghai (CN)

(72) Inventors: Zhong Hui Chen, Suzhou (CN); Wei Ge, Tiantai (CN); Ling Li, Suzhou (CN); Song Liu, Suzhou (CN); Lei Tao, Shanghai (CN)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 56 days.

(21) Appl. No.: 14/890,609

(22) PCT Filed: Sep. 24, 2013

(86) PCT No.: PCT/CN2013/084092

§ 371 (c)(1),
(2) Date: Nov. 12, 2015

(87) PCT Pub. No.: WO2015/042777

PCT Pub. Date: Apr. 2, 2015

(65) Prior Publication Data

US 2016/0086748 A1 Mar. 24, 2016

(51) Int. Cl.

| | |
|---|---|
| ***H01H 13/56*** | (2006.01) |
| ***H01H 13/04*** | (2006.01) |
| *H01H 13/14* | (2006.01) |

(52) U.S. Cl.

CPC ..... *H01H 13/562* (2013.01); *H01H 13/04* (2013.01); *H01H 13/14* (2013.01);
(Continued)

(58) Field of Classification Search

CPC ..... H01H 13/562; H01H 13/04; H01H 13/14; H01H 2235/028; H01H 2221/036

See application file for complete search history.

(56) References Cited

U.S. PATENT DOCUMENTS 3,914,570 A * 10/1975 Lockard ..... H01H 13/562 200/332
4,382,167 A * 5/1983 Maruyama ..... H01H 13/562 200/524

(Continued)

FOREIGN PATENT DOCUMENTS

CN 1339167 A 3/2002
CN 1484843 A 3/2004

(Continued)

OTHER PUBLICATIONS

International Search Report PCT/ISA/210 for International Application No. PCT/CN2013/084092 dated Jan. 21, 2014.

(Continued)

*Primary Examiner* — Felix O Figueroa
(74) *Attorney, Agent, or Firm* — Harness, Dickey & Pierce, P.L.C.

(57) ABSTRACT

A heart-shaped self-locking button includes one housing and one push rod. The push rod is slidably arranged within the housing. A heart-shaped structure is formed on the push rod. The button includes one pin and one flexible element. One end of the pin is fixed on the housing, while the other end is fitted with the heart-shaped structure. The flexible element is arranged between the housing and the push rod and presses the pin towards the heart-shaped structure to allow the pin to be in constant contact with the heart-shaped structure. The heart-shaped structure is arranged on the push rod. Also, the flexible element between the housing and the push rod is utilized to press the pin towards the heart-shaped (Continued)

structure on the push rod to allow the pin to be in constant contact with the heart-shaped structure when moving.

17 Claims, 10 Drawing Sheets

(52) U.S. Cl.
CPC ... *H01H 2221/036* (2013.01); *H01H 2235/01* (2013.01); *H01H 2235/028* (2013.01)

(56) References Cited

U.S. PATENT DOCUMENTS

| | | | | |
|---|---|---|---|---|
| 5,432,312 | A | 7/1995 | Otani et al. | |
| 5,584,384 | A | 12/1996 | Mizuno et al. | |
| 5,670,762 | A * | 9/1997 | Futamura | H01H 13/562 200/524 |
| 7,800,006 | B2 * | 9/2010 | Mishima | H01H 13/562 200/345 |
| 2002/0157935 | A1 | 10/2002 | Bonn et al. | |
| 2004/0066257 | A1 | 4/2004 | Bach et al. | |
| 2008/0251366 | A1 | 10/2008 | Geppert et al. | |

FOREIGN PATENT DOCUMENTS

| | | | |
|---|---|---|---|
| CN | 2692869 | Y | 4/2005 |
| DE | 3427378 | A1 | 1/1986 |
| EP | 1892735 | A1 | 2/2008 |
| JP | S63301436 | A | 12/1988 |
| JP | H06290672 | A | 10/1994 |

OTHER PUBLICATIONS

Written Opinion of the International Searching Authority PCT/ISA/237 for International Application No. PCT/CN2013/084092 dated Jan. 21, 2014.

Extended European Search Report for Corresponding European Patent Application No. 13894580.3 dated Apr. 19, 2017.

* cited by examiner

HEART-SHAPED SELF-LOCKING BUTTON

PRIORITY STATEMENT

This application is the national phase under 35 U.S.C. § 371 of PCT International Application No. PCT/CN2013/084092 which has an International filing date of Sep. 24, 2013, the entire contents of which are hereby incorporated herein by reference.

FIELD

An embodiment of the present invention generally relates to a button, in particular to a heart-shaped self-locking button.

BACKGROUND

A self-locking button is a button having a locking mechanism. During use, the button is pressed down by hand and then the pressure from the hand is released; the button does not spring up completely, but is in a locked state. At this time, a circuit connected to the button is switched on and remains in this state. The button will only spring up completely once the button has been pressed down by hand again, so that the circuit is disconnected. However, self-locking buttons in the prior art have a complex structure, and a relatively short mechanical lifespan, about 500,000 times.

SUMMARY

At least one embodiment of the present invention provides a heart-shaped self-locking button with a simple structure and a longer mechanical lifespan.

At least one embodiment of the present invention is directed to a heart-shaped self-locking button, comprising a housing and a push rod; the push-rod is slideably installed in the housing; a heart-shaped structure is formed on the push rod; the heart-shaped self-locking button further comprises a pin and an elastic element; one end of the pin is fixed to the housing, while another end of the pin cooperates with the heart-shaped structure; the elastic element is disposed between the housing and the push rod and presses the pin towards the heart-shaped structure so that the pin maintains contact with the heart-shaped structure.

In one embodiment, the pin comprises a body, an installation part and an insertion part; the installation part is formed at a first end of the body in a perpendicular fashion and is fixed to the housing; the insertion part is formed at 85°-88° at a second end of the body and cooperates with the heart-shaped structure; the elastic element bears against the body and presses the pin towards the push rod.

In one embodiment, the body is linear; the insertion part and the installation part extend in opposite directions from two ends of the body.

In one embodiment, the elastic element comprises a spring plate; the spring plate is disposed in a sloping fashion between the housing and the push rod; the spring plate bears against the body and presses the pin towards the push rod.

In one embodiment, a groove is formed inside the housing; the elastic element further comprises two bases and at least one connecting part; the two bases are located on two sides of the groove; the connecting part is located between and connects the two bases; the connecting part is disposed in a protruding fashion on the two bases; the connecting part is installed in the groove; and the spring plate is disposed in a sloping fashion on the connecting part.

In one embodiment, at least one stop block is also formed inside the housing; the stop block is disposed so as to be spaced apart from an inner surface of the housing; the two bases are held between the inner surface of the housing and the stop block.

In one embodiment, a stop part is also formed inside the housing; the groove extends to the stop part in an axial direction of the housing; a first connecting part is formed on the stop part; a second connecting part is formed on the bases; the second connecting part and the first connecting part cooperate.

In one embodiment, the second connecting part is a hole structure/projection structure formed on the bases; the first connecting part is a projection structure/hole structure formed on the stop part.

In one embodiment, a stop is formed on the bases; the stop forms an interference fit with the stop block.

In one embodiment, the heart-shaped structure comprises a heart, a channel and at least two step parts; the heart has a recess; the channel is arranged to extend around the heart, and has a starting position and a self-locking position; the starting position is the position of the insertion part in the channel when the heart-shaped self-locking button has not been pressed; the self-locking position is located at the recess on the heart; the step parts are located in the channel, and the heights of the step parts relative to a lowest surface of the channel unidirectionally decrease progressively in a direction in which the heart is encircled, starting from the starting position.

In one embodiment, the pin is formed by bending a metal wire.

In one embodiment, an end face of the insertion part is smooth.

In one embodiment, at least one tubular body limiting part and at least one engagement block are also formed inside the housing; at least one push rod limiting part and at least one engagement hook are also formed on the push rod; the push rod limiting part and the engagement hook cooperate with the tubular body limiting part and the engagement block, respectively, so as to define a range of movement of the push rod in the housing.

The heart-shaped structure of the heart-shaped self-locking button in one embodiment of the present invention is made on the push rod, so that the mold is simple and costs are low; moreover, the heart-shaped self-locking button uses the elastic element between the housing and the push rod to press the pin towards the heart-shaped structure on the push rod, so that the pin is in contact with the heart-shaped structure throughout the process of the pin moving in the heart-shaped structure, and the heart-shaped self-locking button can more reliably realize the self-locking function and have a longer mechanical lifespan.

The description above is merely an overview of embodiments of the present invention. To enable a clearer understanding of the technical devices employed in embodiments of the present invention, and implementation thereof according to the content of the specification, and to make the abovementioned and other objects, features and advantages of the present invention clearer and easier to understand, preferred embodiments are explained in detail below in conjunction with the accompanying drawings.

Figure 1:
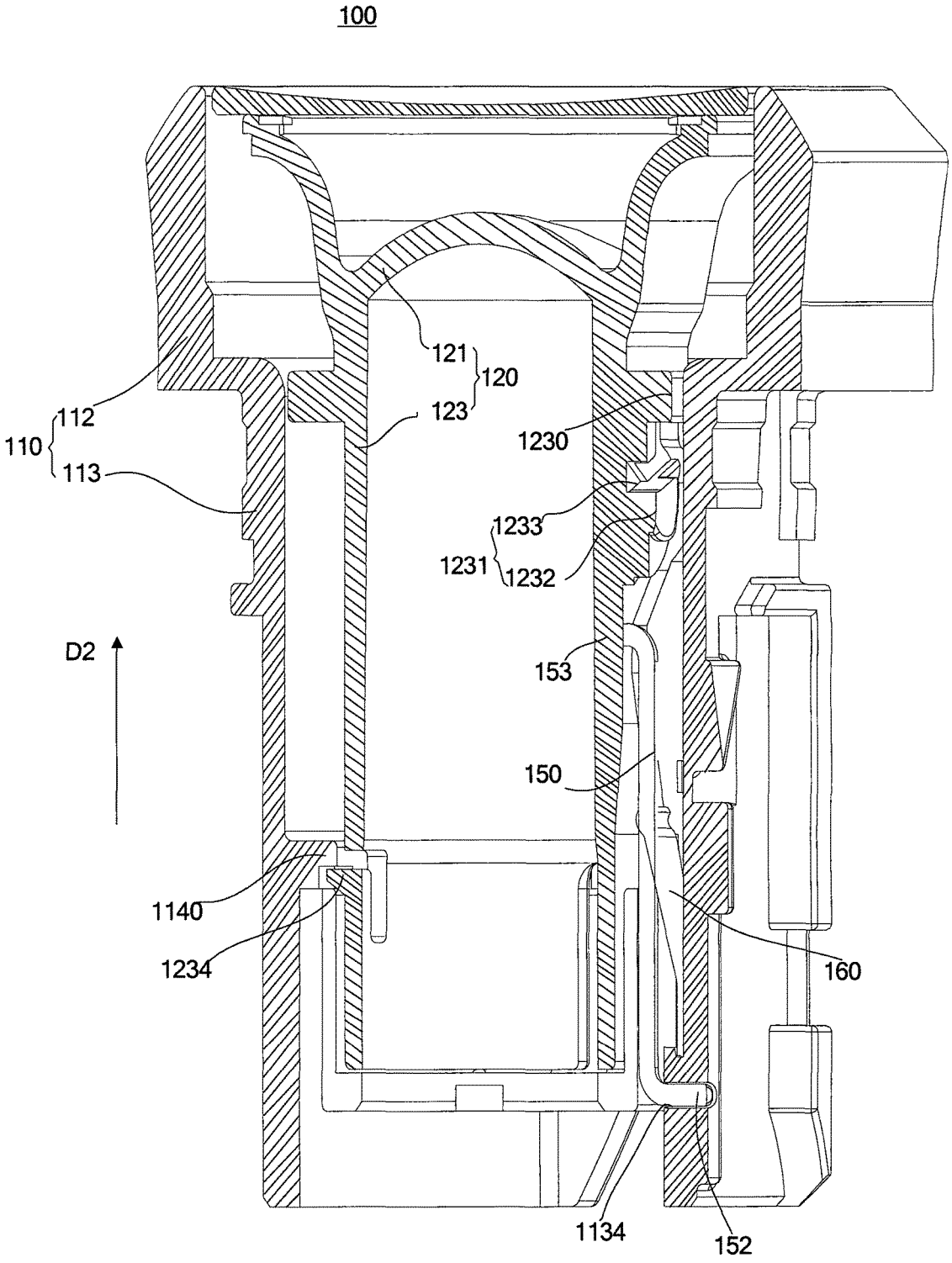
FIG. 1 is a schematic diagram of the interior of the heart-shaped self-locking button in an embodiment of the present invention with the return spring omitted.

The labels used in the accompanying drawings comprise:

100 heart-shaped self-locking button
110 housing
112 head part
113 tubular body
1130 inner surface
1132 tubular body limiting part
1134 installation hole
1135 groove
1137 stop block
1138 stop part
1139 first connecting part
1140 engagement block
120 push rod
121 operating part
123 pipe body
1230 outer surface
1231 heart-shaped structure
1232 heart
1233 channel
1234 engagement hook
1235 self-locking position
1236 step part
1237 starting position
1238 turning-point position
1239 push rod limiting part
1240 lowest surface
130 return spring
150 pin
151 body
152 installation part
153 insertion part
160 elastic element
161 base
1612 stop
1613 second connecting part
162 connecting part
163 spring plate

DETAILED DESCRIPTION OF EXAMPLE EMBODIMENTS

In order to clarify the technical problems solved by embodiments of the present invention, as well as the technical solution and beneficial effects thereof, the present invention is explained in further detail below in conjunction with the accompanying drawings and embodiments. It should be understood that the particular embodiments described here are merely intended to explain the present invention, not to define it.

Figure 2:
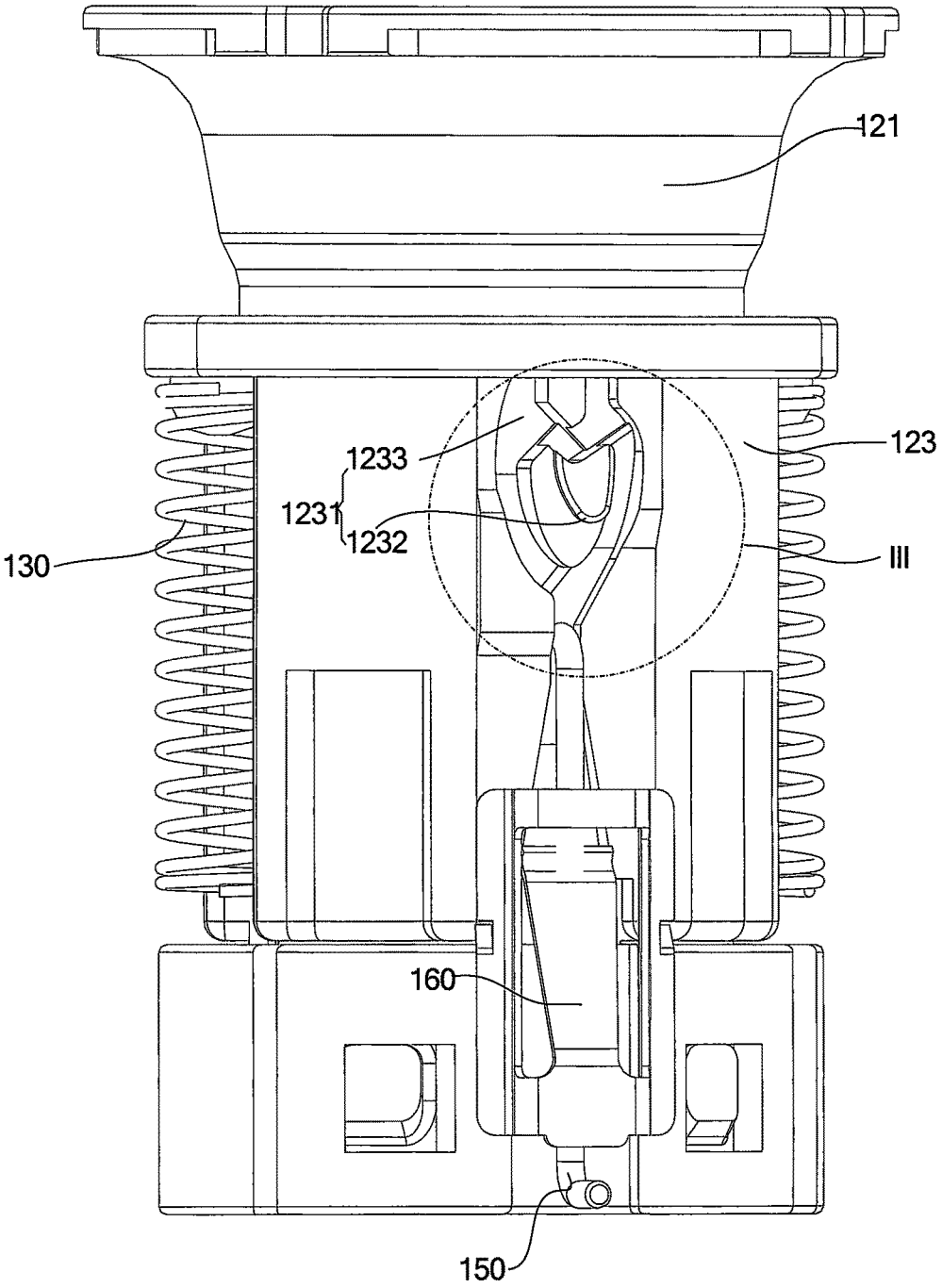
FIG. 2 is a schematic diagram of the heart-shaped self-locking button in FIG. 1 with the housing omitted.

FIG. 1 shows a schematic diagram of the interior of the heart-shaped self-locking button in an embodiment of the present invention with the return spring omitted. FIG. 2 shows a schematic diagram of the heart-shaped self-locking button in FIG. 1 with the housing omitted. As FIGS. 1 and 2 show, the heart-shaped self-locking button 100 comprises a housing 110, a push rod 120, a return spring 130, a pin 150 and an elastic element 160. A heart-shaped structure 1231 is formed on the push rod 120, and the push rod 120 is slideably installed in the housing 110; the return spring 130 can be used to return the push rod 120 to an initial position; the elastic element 160 is disposed between the housing 110 and the push rod 120, and presses the pin 150 towards the heart-shaped structure 1231 such that the pin 150 and the heart-shaped structure 1231 maintain contact; the pin 150 can move in the heart-shaped structure 1231 so as to realize the self-locking function of the self-locking button 100.

Figure 4:
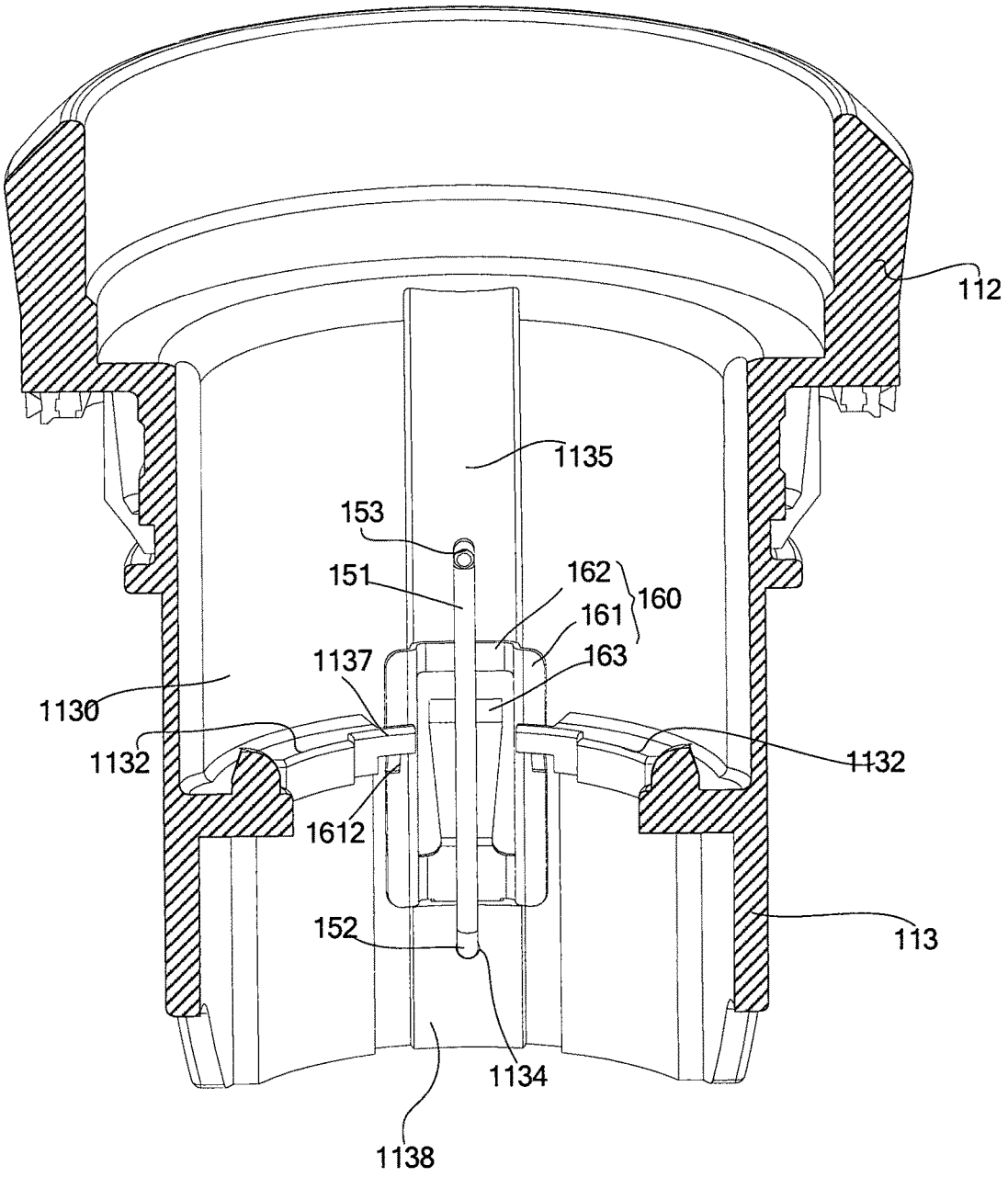
FIG. 4 is a schematic diagram showing the relationship among the housing, pin and elastic element of the heart-shaped self-locking button in FIG. 1.

Specifically, as FIGS. 1 and 4 show, the housing 110 comprises a head part 112 and a tubular body 113. The head part 112 and tubular body 113 are substantially cylindrical, and the dimensions such as diameter of the head part 112 are greater than the dimensions such as diameter of the tubular body 113. Here, "cylindrical" may include hollow prisms or similar shapes.

Figure 9:
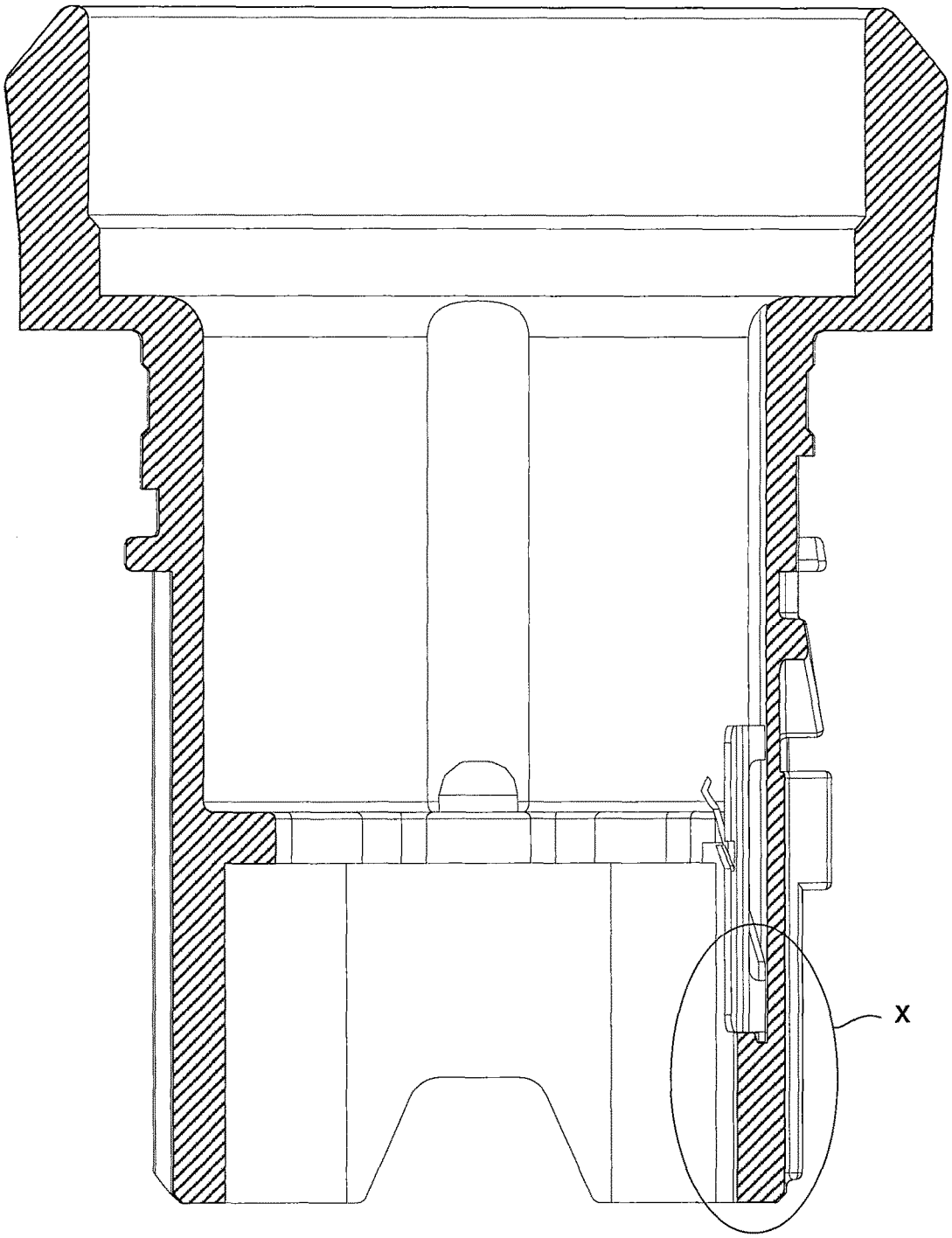
FIG. 9 is a schematic diagram showing the relationship between the housing and the elastic element.
Figure 10:
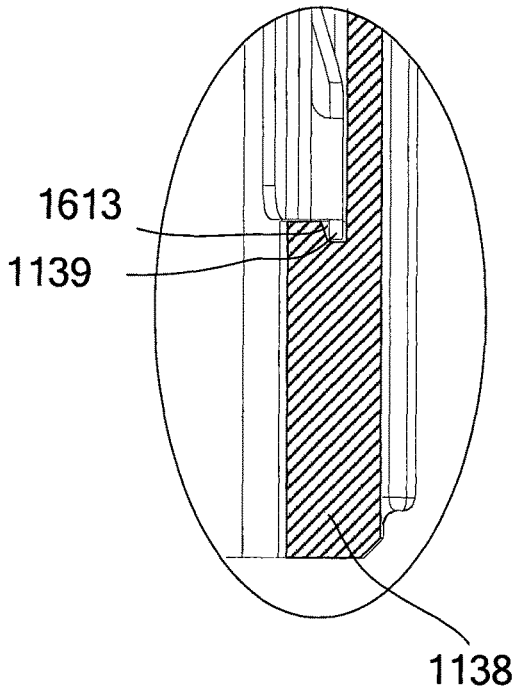
FIG. 10 is an enlarged schematic diagram of circled part X in FIG. 9.
Figure 11:
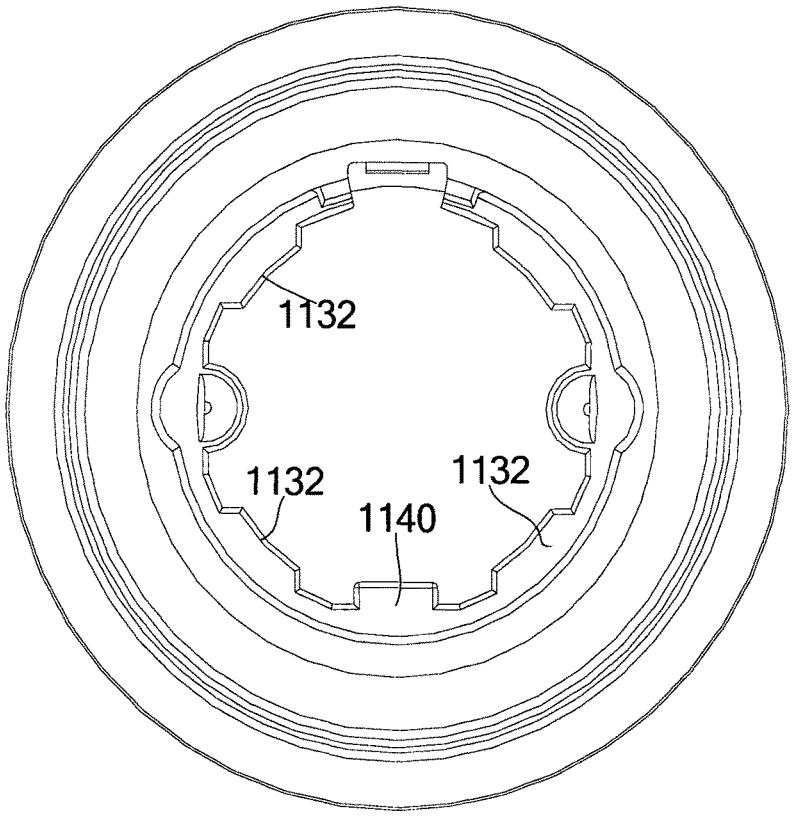
FIG. 11 is a view of the housing from above.

As FIGS. 4 and 9-11 show, inside the tubular body 113 are formed at least one tubular body limiting part 1132, an installation hole 1134, a groove 1135, a stop part 1138 and at least one engagement block. In the embodiment shown in FIG. 4, the stop part 1138 is formed on an inner surface 1130 of the tubular body 113. As FIG. 10 shows, a first connecting part 1139 may be formed on the stop part 1138. In one embodiment, the first connecting part 1139 is a hole structure formed on the stop part 1138. The groove 1135 is formed on the inner surface 1130 of the tubular body 113, and extends to the stop part 1138 substantially in an axial direction of the tubular body 113. As FIG. 11 shows, the tubular body limiting parts 1132 and engagement block 1140 are formed so as to be spaced apart on the inner surface 1130 of the tubular body 113. The tubular body limiting parts 1132 are located on two sides of the groove 1135 in a circumferential direction of the tubular body 113. The tubular body limiting parts 1132 may be protruding structures formed on the inner surface 1130 of the tubular body 113. A stop block 1137 may also be formed on each tubular body limiting part 1132. The stop block 1137 is formed on that end of the tubular body limiting part 1132 which is close to the groove 1135. Each stop block 1137 is disposed so as to be spaced apart from the inner surface 1130 of the tubular body 113 and extends towards another stop block 1137 substantially in the circumferential direction of the tubular body 113. The installation hole 1134 may be formed in the stop part 1138.

Figure 3:
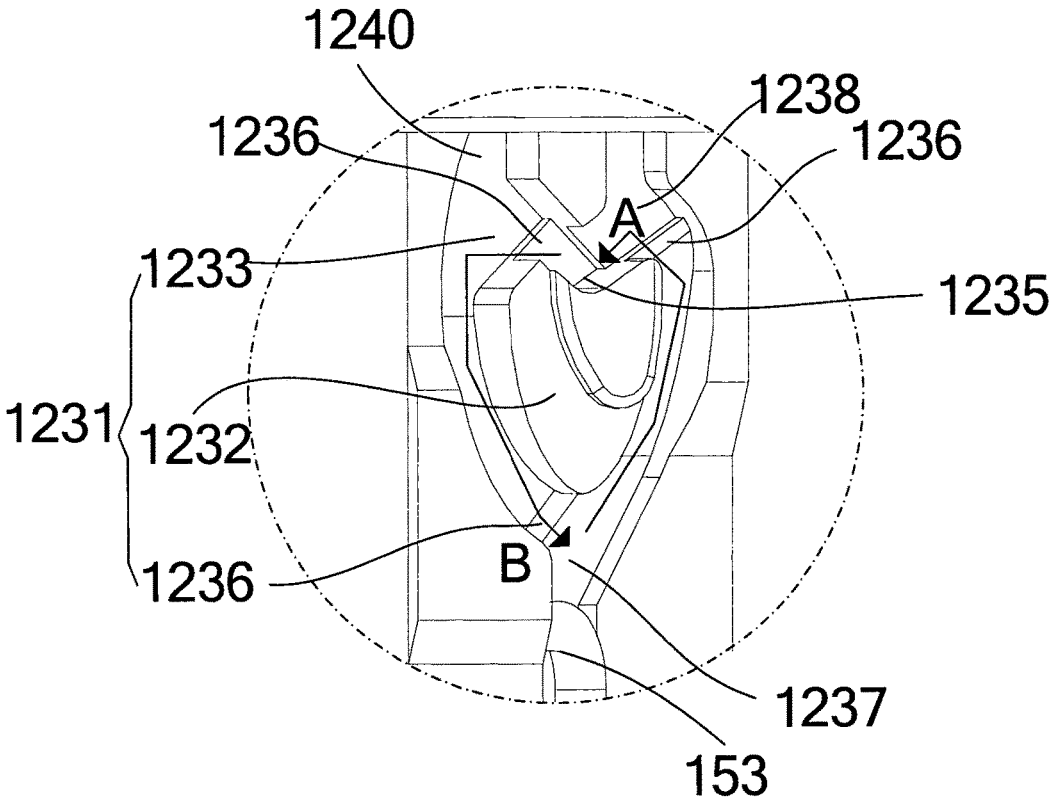
FIG. 3 is an enlarged schematic diagram of circled part III in FIG. 2.

The push rod 120 is slideably installed in the housing 110. As FIGS. 1 and 2 show, the push rod 120 comprises an operating part 121 and a pipe body 123. The operating part 121 is located in the head part 112 of the housing 110. The pipe body 123 is installed in the tubular body 113 of the housing 110. When a user presses the operating part 121, the pipe body 123 can move in the tubular body 113 substantially in the axial direction of the tubular body 113. The pipe body 123 is substantially cylindrical. The pipe body 123 has an outer surface 1230. The heart-shaped structure 1231 is formed on the outer surface 1230 of the pipe body 123. As FIGS. 1 to 3 show, the heart-shaped structure 1231 comprises a heart 1232, a channel 1233 and at least two step parts 1236. The channel 1233 is arranged to extend around the heart 1232, and the channel 1233 has a starting position 1237, a self-locking position 1235 and a turning-point position 1238. The starting position 1237 is the position of the pin 150 in the channel 1233 when the heart-shaped self-locking button 100 has not been pressed. The self-locking position 1235 may be located in a recess on the heart 1232. The turning-point position 1238 is close to the self-locking position 1235, and the pin 150 reaches the self-locking position 1235 from the starting position 1237 after passing the turning-point position 1238. The step parts 1236 are located in the channel 1233, and the heights of the step parts 1236 relative to a lowest surface 1240 of the channel 1233 change unidirectionally in a direction in which the heart 1232 is encircled, i.e. clockwise or anticlockwise. For example, in the embodiment shown in FIG. 3, starting from the starting position 1237, the heights of the multiple step parts 1236 relative to the lowest surface 1240 of the channel 1233 unidirectionally decrease progressively in the anti-clockwise direction, to prevent the pin 150 from moving in the opposite direction.

Figure 7:
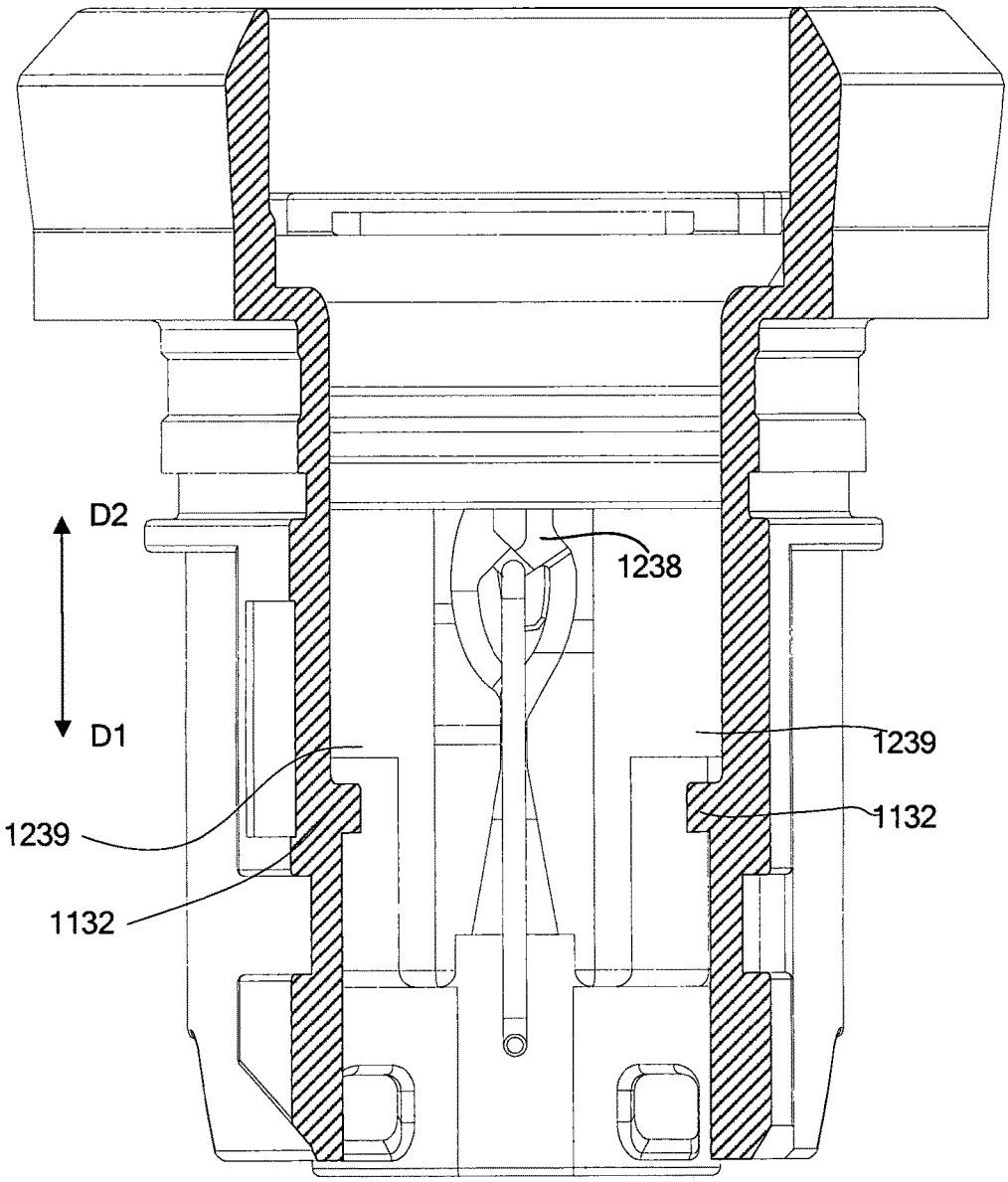
FIG. 7 is a schematic diagram of the interior of the heart-shaped self-locking button in FIG. 1 viewed from another angle, with only the housing, push rod and pin shown, wherein the heart-shaped self-locking button is in a self-locked state.
Figure 8:
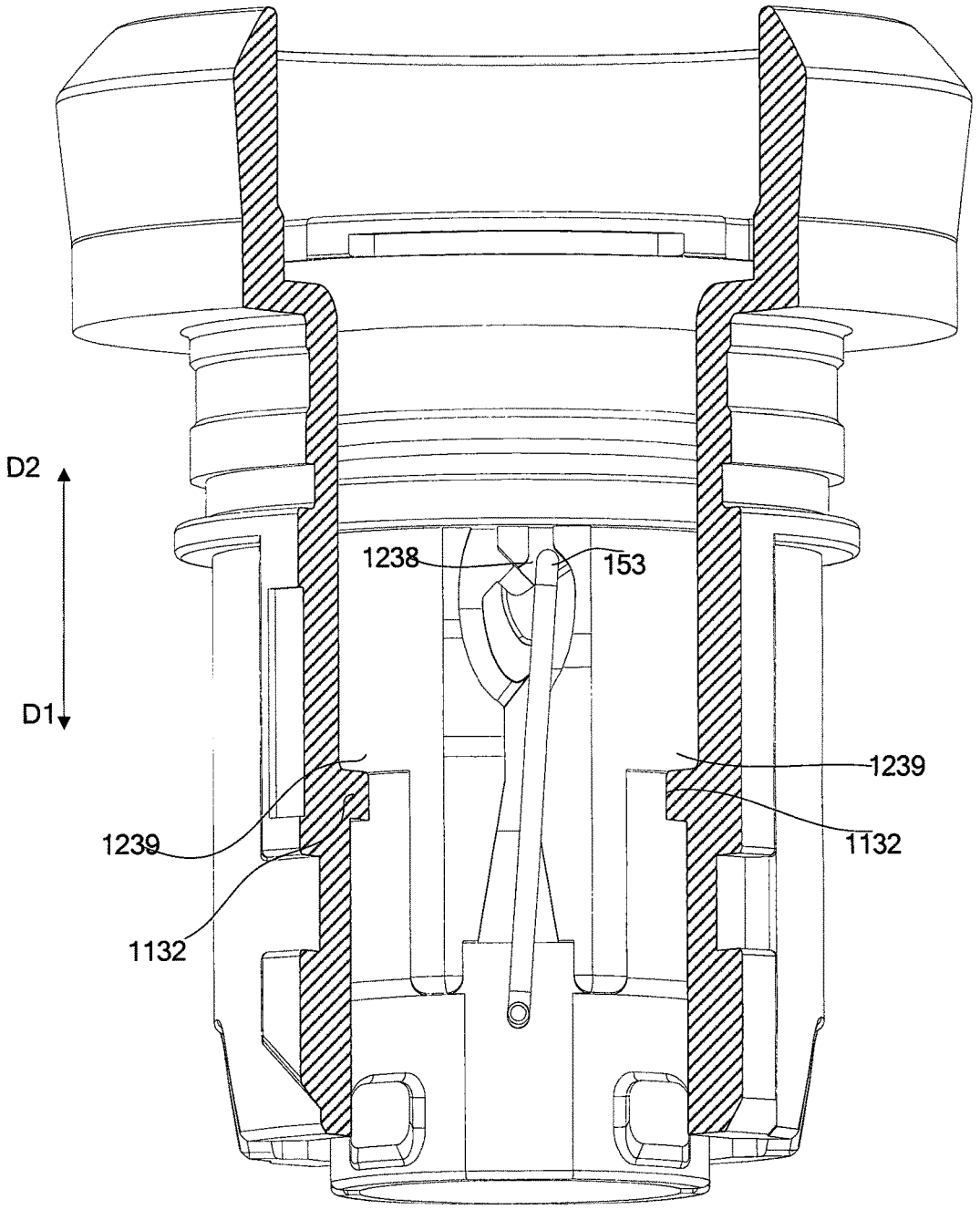
FIG. 8 is similar to FIG. 7, wherein the pin of the heart-shaped self-locking button is at the turning-point position.

Furthermore, as FIGS. 7 and 8 show, at least one push rod limiting part 1239 is also formed on the outer surface 1230 of the pipe body 123. The push rod limiting part 1239 can cooperate with the tubular body limiting part 1132 (as shown in FIG. 8), so as to limit movement of the push rod 120 in a direction D1 relative to the tubular body 113 in the axial direction of the tubular body 113. Furthermore, as FIG. 1 shows, an engagement hook 1234 is also formed on the outer surface 1230 of the pipe body 123. Relative to the push rod limiting part 1239, the engagement hook 1234 is remote from the operating part 121. The engagement hook 1234 can cooperate with the engagement block 1140 on the tubular body 113 such as by engagement, so as to limit movement of the push rod 120 in a direction D2 relative to the tubular body 113 in the axial direction of the tubular body 113. Therefore the push rod 120 will not be disengaged from the housing 110 under the action of the return spring 130. In other words, once pressure from the hand is released or a fixture is installed, the return spring 130 will not push the push rod 120 out of the housing 110. Thus, the range of movement of the pipe body 123 in the tubular body 113 is limited through cooperation between the push rod limiting part 1239 and the tubular body limiting part 1132 and through cooperation between the engagement hook 1234 and the engagement block 1140.

The return spring 130 surrounds the push rod 120 and is located in the housing 110. The return spring 130 may be used to return the push rod 120 to an initial position.

Figure 5:
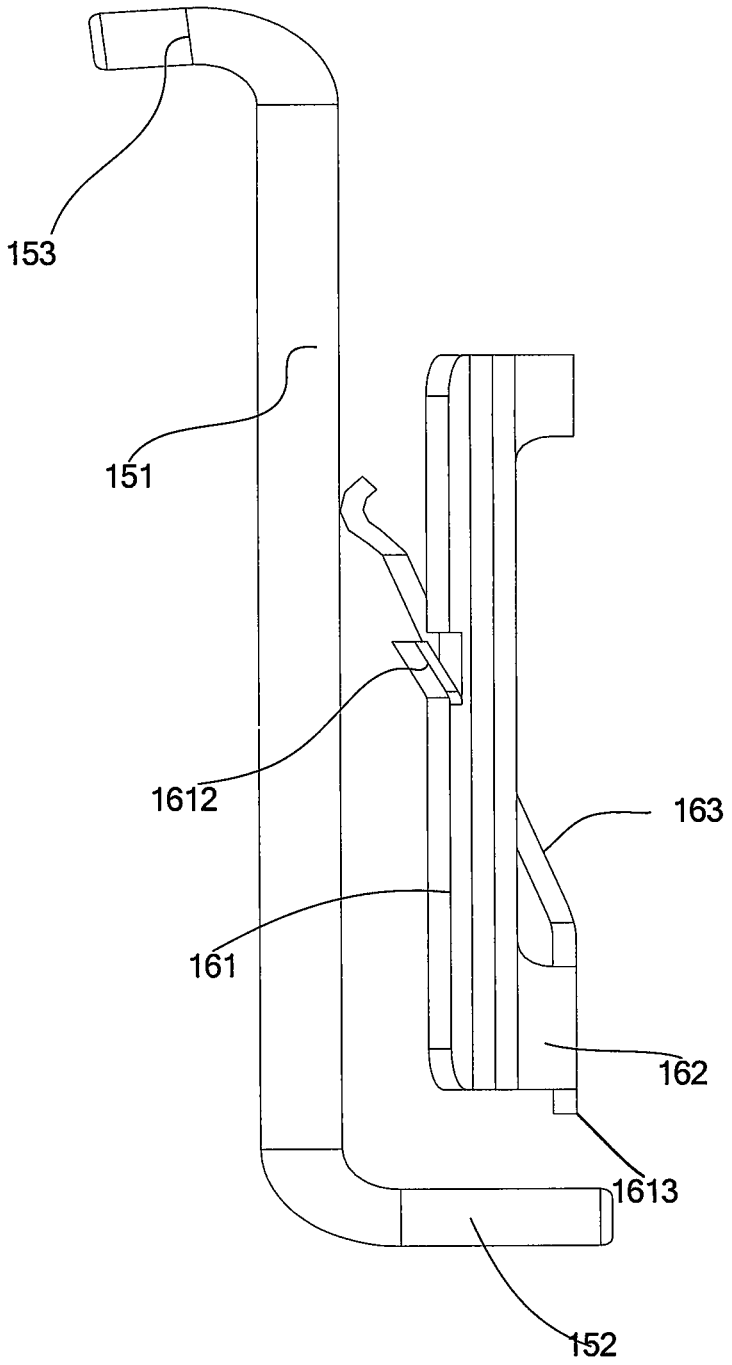
FIG. 5 is an enlarged schematic diagram of the pin and elastic element in FIG. 4.

The pin 150 may be formed by bending a metal wire etc. In the embodiment shown in FIG. 5, the pin 150 may be formed by bending a stainless steel wire of diameter 0.7 mm. As FIG. 5 shows, the pin 150 comprises a body 151, an installation part 152 and an insertion part 153. The body 151 is substantially linear, and may be substantially parallel to the axial direction of the tubular body 113. The installation part 152 is formed at a first end of the body 151 in a substantially perpendicular fashion. The installation part 152 may be installed in the installation hole 1134 of the tubular body 113 by a clearance fit etc., thereby installing the pin 150 on the housing 110. The insertion part 153 is formed at substantially 85°-88° at a second end of the body 151, and inserted in the channel 1233 of the heart-shaped structure 1230. The installation part 152 and insertion part 153 extend in opposite directions from two ends of the body 151. Preferably, an end face of the insertion part 153 may be polished smooth.

As FIG. 4 shows, the elastic element 160 comprises two bases 161, at least one connecting part 162 and a spring plate 163. The two bases 161 are located on two sides of the groove 1135, each base being held between the inner surface 1130 of the tubular body 113 and the corresponding stop block 1137, and can limit movement of the elastic element 160 in a horizontal direction of the tubular body 113. The connecting part 162 is located between and connects the two bases 161. The connecting part 162 is disposed in a protruding fashion on the two bases 161. In one embodiment, the connecting part 162 may be installed in the groove 1135 by sliding, so as to install the elastic element 160 on the housing 110. The spring plate 163 may extend in a sloping fashion towards the pin 150 from the connecting part 162, and bear against the body 151 of the pin 150, so that the insertion part 153 of the pin 150 is inserted into the channel 1233 of the heart-shaped structure 1230 and maintains contact. In order to reduce friction between the spring plate 163 and the body 151 of the pin 150, as shown in FIG. 5, the free end of the spring plate 163 may be designed to be arc-shaped.

Furthermore, in order to limit movement of the elastic element 160 in the axial direction of the tubular body 113, as shown in FIG. 5, a stop 1612 and a second connecting part 1613 may be formed on the bases 161. The stop 1612 can cooperate with the stop block 1137 such as by bearing against the latter. The second connecting part 1613 may be a projection structure formed on the bases 161 (as shown in FIGS. 5 and 9-10). The second connecting part 1613 can cooperate with the first connecting part 1139 in the stop part 1138 such as by insertion of the second connecting part 1613 in the first connecting part 1139, as shown in FIG. 10. Movement of the elastic element 160 in the axial direction of the tubular body 113 can be limited through cooperation between the stop 1612 and the stop block 1137 and through cooperation between the second connecting part 1613 and the first connecting part 1139. In another embodiment, the second connecting part 1613 may be a hole structure formed on the bases 161, and correspondingly, the first connecting part 1139 may be a projection structure formed on the stop part 1138.

The specific structure of the heart-shaped self-locking button 100 in an embodiment of the present invention is described above; the method of use thereof is described briefly below.

During use, a user presses the operating part 121 of the push rod 120 so that the push rod 120 moves in direction D1 substantially in the axial direction of the tubular body 113; at the same time, the insertion part 153 of the pin 150 begins to move from the starting position 1237 in the channel 1233 towards the self-locking position 1235 in the direction indicated by arrow A in FIG. 3. When the insertion part 153 of the pin 150 moves to the turning-point position 1238, the user releases hand pressure (in other words, as shown in FIG. 8, due to the limiting relationship between the push rod limiting part 1239 and the tubular body limiting part 1132, the user's pressing operation is just able to move the insertion part 153 of the pin 150 to the turning-point position 1238). Next, as shown in FIG. 7, the push rod 120 moves in direction D2 substantially in the axial direction of the tubular body 113 under the action of the return spring 130, then the insertion part 153 of the pin 150 moves from the turning-point position 1238 to the self-locking position 1235, i.e. the recess on the heart 1232; therefore the insertion part 153 of the pin 150 and the recess on the heart 1232 cooperate to prevent further movement of the push rod 120 in direction D2, so as to realize self-locking of the heart-shaped self-locking button 100.

As FIGS. 3 and 7 show, when the user presses the operating part 121 of the push rod 120 again so that the push rod 120 moves substantially in direction D1, the insertion part 153 of the pin 150 begins to move from the self-locking position 1235 towards the starting position 1237 in the direction indicated by arrow B in FIG. 3. When the insertion part 153 moves to the lowest surface 1240, the insertion part 153 begins to climb to a certain height and then passes a step part 1236, thereby returning to the starting position 1237, so that the heart-shaped self-locking button 100 springs up completely.

Throughout the above process, the spring plate 163 bears against the body 151 of the pin 150 and presses the pin 150 towards the push rod 120, so that the insertion part 153 is in contact with each surface of the channel 1233 throughout the process of the insertion part moving in the channel 1233. Furthermore, since the heights of the multiple step parts 1236 relative to the lowest surface 1240 of the channel 1233 unidirectionally decrease progressively in the anticlockwise direction, movement of the pin 150 in the opposite direction can be prevented, so that faults caused by the pin 150 moving round in a backwards direction can be avoided.

As stated above, the heart-shaped self-locking button 100 in an embodiment of the present invention can have the following key features:

1. The heart-shaped structure 1231 of the heart-shaped self-locking button 100 is made on the push rod 120, so that the mold is simple and costs are low.

2. The heart-shaped self-locking button 100 uses the elastic element 160 between the housing 110 and the push rod 120 to press the pin 150 towards the heart-shaped structure 1231 on the push rod 120, so that the insertion part 153 of the pin 150 is in contact with the heart-shaped structure 1231 throughout the process of the insertion part moving in the heart-shaped structure 1231, and the heart-shaped self-locking button 100 can more reliably realize the self-locking function and have a longer mechanical lifespan; in one embodiment, the mechanical lifespan of the heart-shaped self-locking button 100 can reach about 1 million times, which is approximately twice the mechanical lifespan of an existing self-locking button.

Figure 6:
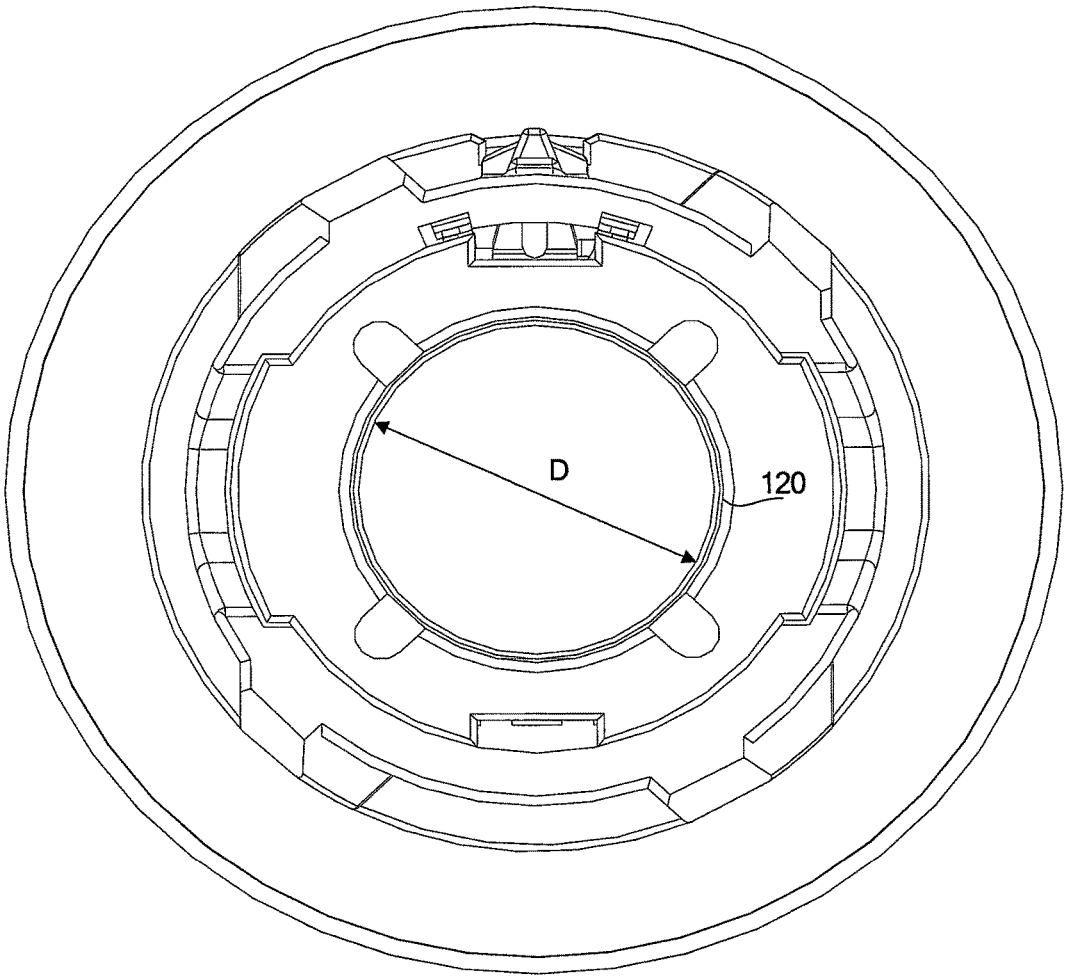
FIG. 6 is a view of the heart-shaped self-locking button in FIG. 1 from below.

3. Since the elastic element 160 and pin 150 have relatively small dimensions in the radial direction of the heart-shaped self-locking button 100, the push rod 120 can be given a relatively large internal diameter D, as shown in FIG. 6; in one embodiment, the internal diameter D of the push rod 120 is approximately 10 mm; this provides as large a space as possible for the propagation of light from a self-locking button equipped with a lamp, and increases the visual appeal of the product.

4. Arc-surface contact may be employed between the spring plate 163 of the elastic element 160 and the pin 150, reducing frictional losses between components, and further increasing the service life of the product.

In summary, disclosed in embodiments of the present invention is a heart-shaped self-locking button, comprising a housing and a push rod; the push-rod is slideably installed in the housing; a heart-shaped structure is formed on the push rod; the heart-shaped self-locking button further comprises a pin and an elastic element; one end of the pin is fixed to the housing, while another end of the pin cooperates with the heart-shaped structure; the elastic element is disposed between the housing and the push rod and presses the pin towards the heart-shaped structure so that the pin maintains contact with the heart-shaped structure. The heart-shaped structure of the heart-shaped self-locking button in one embodiment of the present invention is made on the push rod, so that the mold is simple and costs are low; moreover, the heart-shaped self-locking button uses the elastic element between the housing and the push rod to press the pin towards the heart-shaped structure on the push rod, so that the pin is in contact with the heart-shaped structure throughout the process of the pin moving in the heart-shaped structure, and the heart-shaped self-locking button can more reliably realize the self-locking function and have a longer mechanical lifespan.

The above embodiments are merely preferred embodiments of the present invention, which are not intended to limit it. Any amendments, equivalent substitutions or improvements etc. made within the spirit and principles of the present invention shall be included in the scope of protection thereof.

The invention claimed is:

1. A heart-shaped self-locking button, comprising:

a housing having a groove formed therein;

a push rod, the push-rod being slideably installed in the housing;

a heart-shaped structure formed on the push rod;

a pin; and an elastic element having two bases located outside of the groove and on an inner surface of the housing, each base being configured to limit movement of the elastic element in a direction perpendicular to a longitudinal axis of the groove, wherein one end of the pin is fixed to the housing and another end of the pin is configured to cooperate with the heart-shaped structure, the elastic element being disposed between the housing and the push rod and being configured to press the pin towards the heart-shaped structure so that the pin maintains contact with the heart-shaped structure.

2. The heart-shaped self-locking button of claim 1, wherein the pin includes a body, an installation part and an insertion part; the installation part is formed at the one end of the pin in a perpendicular fashion and is fixed to the housing; the insertion part is formed at 85°-88° at the another end of the pin and is configured to cooperate with the heart-shaped structure; and the elastic element is configured to bear against the body and press the pin towards the push rod.

3. The heart-shaped self-locking button of claim 2, wherein the body is linear; and wherein the insertion part and the installation part extend in opposite directions from the one end and the another end of the pin.

4. The heart-shaped self-locking button of claim 2, wherein the elastic element comprises a spring plate; the spring plate is disposed in a sloping fashion between the housing and the push rod; the spring plate is configured to bear against the body and press the pin towards the push rod.

5. The heart-shaped self-locking button of claim 4, wherein the elastic element further comprises at least one connecting part located between and connecting the two bases; the connecting part is disposed in a protruding fashion on the two bases; the connecting part is in the groove; and the spring plate is disposed in a sloping fashion on the connecting part.

6. The heart-shaped self-locking button of claim 5, wherein at least one stop block is formed inside the housing; the stop block is disposed so as to be spaced apart from the inner surface of the housing; and the two bases are held between the inner surface of the housing and the stop block.

7. The heart-shaped self-locking button of claim 6, wherein a stop part is formed inside the housing; the groove extends to the stop part in an axial direction of the housing; a first connecting part is formed on the stop part; a second connecting part is formed on the bases; and the second connecting part and the first connecting part are configured to cooperate.

8. The heart-shaped self-locking button of claim 7, wherein the second connecting part is a hole structure/projection structure formed on the bases; and wherein the first connecting part is a projection structure/hole structure formed on the stop part.

9. The heart-shaped self-locking button of claim 6, wherein a stop is formed on the bases; and wherein the stop forms an interference fit with the stop block.

10. The heart-shaped self-locking button of claim 2, wherein the heart-shaped structure comprises a heart, a channel and at least two step parts;

the heart including a recess;

the channel being arranged to extend around the heart, and including a starting position and a self-locking position; the starting position being the position of the insertion part in the channel when the heart-shaped self-locking button has not been pressed, the self-locking position being located at the recess on the heart; and the step parts being located in the channel, and heights of the step parts relative to a relatively lowest surface of the channel unidirectionally decreasing progressively in a direction in which the heart is encircled, starting from the starting position.

11. The heart-shaped self-locking button of claim 1, wherein the pin is formed by bending a metal wire.

12. The heart-shaped self-locking button of claim 11, wherein an end face of the insertion part is smooth.

13. The heart-shaped self-locking button of claim 1, wherein at least one tubular body limiting part and at least one engagement block are formed inside the housing; and at least one push rod limiting part and at least one engagement hook are formed on the push rod, the push rod limiting part and the engagement hook being configured to cooperate with the tubular body limiting part and the engagement block, respectively, so as to define a range of movement of the push rod in the housing.

14. The heart-shaped self-locking button of claim 2, wherein the pin is formed by bending a metal wire.

15. The heart-shaped self-locking button of claim 14, wherein an end face of the insertion part is smooth.

16. The heart-shaped self-locking button of claim 2, wherein at least one tubular body limiting part and at least one engagement block are formed inside the housing; and at least one push rod limiting part and at least one engagement hook are formed on the push rod, the push rod limiting part and the engagement hook being configured to cooperate with the tubular body limiting part and the engagement block, respectively, so as to define a range of movement of the push rod in the housing.

17. The heart-shaped self-locking button of claim 2, wherein the heart-shaped structure protrudes from the outer surface of the pipe body toward the housing.

* * * * *